United States Patent [19]

Ellis

[11] 4,095,286

[45] June 13, 1978

[54] AGITATOR FOR PAINT SPRAY CANS

[76] Inventor: Jerry Ellis, 6520 Shadowlawn, Dearborn Heights, Mich. 48127

[21] Appl. No.: 646,537

[22] Filed: Jan. 5, 1976

[51] Int. Cl.[2] ..... B01F 7/18

[52] U.S. Cl. ..... 366/293; 366/325; 366/343

[58] Field of Search ..... 259/DIG. 38, 108, 121, 259/122, 107, 103, DIG. 46, 106; 118/610; 222/193, 236, 238; 308/187.1, 187.2, 36.1; 415/212, 92

[56] References Cited

U.S. PATENT DOCUMENTS

| | | | |
|---|---|---|---|
| 1,443,738 | 1/1923 | Gibson | 259/DIG. 38 |
| 1,447,653 | 3/1923 | Fish | 259/DIG. 38 |
| 2,284,155 | 5/1942 | Landgraf | 259/108 |
| 2,635,931 | 4/1953 | May | 308/36.1 |
| 2,871,562 | 2/1959 | Kern | 415/92 |
| 2,901,295 | 8/1959 | Becker | 308/36.1 |
| 3,175,293 | 3/1965 | Borden | 415/92 |
| 3,672,645 | 6/1972 | Terrels | 259/122 |
| 3,863,903 | 2/1975 | Brehmer et al. | 259/108 |

*Primary Examiner*—Robert W. Jenkins

[57] ABSTRACT

A universal agitator for use with a paint spray can and gun is fluid operated off the same fluid source used to power the spray gun. The agitator comprises a vaned paddle wheel which is mounted on a shaft and which is disposed in the paint can. The shaft has a splined portion which is sealed in a housing. The fluid source rotates the shaft to likewise rotate the paddle wheel to maintain the paint in an agitated state.

7 Claims, 4 Drawing Figures

AGITATOR FOR PAINT SPRAY CANS

BACKGROUND OF THE INVENTION

1. Field of the Invention

The present invention pertains to paint spray assemblies. More particularly, the present invention pertains to agitators for use with paint spray assemblies. Even more particularly, the present invention pertains to fluid operated agitators for paint spray systems and assemblies.

2. Prior Art

Conventionally, today, metallic surfaces or bodies, such as automobile bodies, are painted by the spray application of paint thereonto. Generally, a pressurized fluid, and, usually, air is passed through a nozzle or gun which creates a suction or vacuum in a source of paint in communication with the nozzle or gun. The suction or vacuum draws the paint through the nozzle or gun which, in turn, aspirates the paint as it is applied to the metallic surface or body. Modern day paints and, in particular, those used in painting automobile surfaces, have metallic pigments suspended in a liquid. The pigments, because of their density or specific gravity have a strong tendency to settle out of suspension. Thus, large effort has been expended to develop suitable modes to keep the pigments uniformly suspended in the liquid. See, inter alia, U.S. Pat. Nos. 3,672,645; 2,846,123; 1,784,416; 3,173,584 and 1,733,724. However, the prior art is deficient in that the agitators are specifically adapted for use with cups or containers dimensioned to accomodate the specific agitator. Furthermore, the prior art systems are quite expensive. Thus, a major advance in the art would be provided by an inexpensive universal agitator. It is to this with which the present invention is concerned.

SUMMARY OF THE INVENTION

In accordance with the present invention there is provided an agitator for a paint spray system or assembly. The agitator comprises a vaned paddle wheel which is journalled on a shaft. A portion of the shaft within the housing has a splined section.

Pressurized fluid, such as air, is passed through the housing and impinges upon the splines to rotate the shaft. The rotation of the shaft causes the paddle wheel to rotate thereby agitating paint within the cup or container therefor.

The present invention, also, provides that a portion of the air used to power the spray assembly is diverted to rotate the shaft.

For a more complete understanding of the present invention reference is made to the following detailed description and accompanying drawing. In the drawing like reference characters refer to like parts throughout the several views, in which:

DETAILED DESCRIPTION OF THE PREFERRED EMBODIMENT

Figure 1:
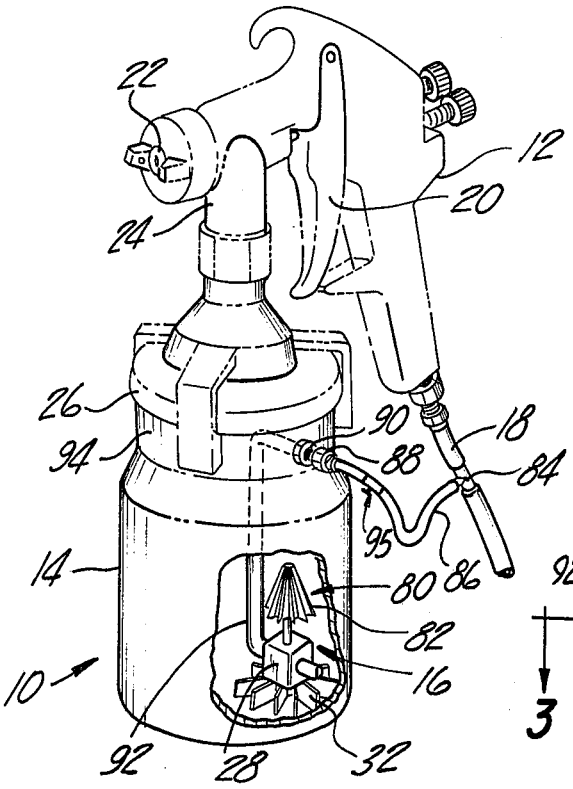
FIG. 1 is a perspective view, partially cut-away depicting a spray paint assembly utilizing the agitator of the present invention.

Now, with reference to the drawing, there is depicted therein, a spray paint assembly, generally, denoted at 10. The assembly 10, generally, comprises a spray gun or nozzle 12, a cup or container for the paint 14 and an agitator, in accordance with the present invention, generally, indicated at 16.

With more particularity, the spray gun or nozzle 12 is a conventional apparatus and well known to the skilled artisan. The spray gun 12 is connected through a conduit 18 to a source of pressurized fluid (not shown), such as compressed air. By drawing back on the trigger 20 of the gun 12 suitable valving is opened to permit the pressurized fluid to pass through the gun and out of the barrel head 22. As is, also, known to those skilled in the art, as the air passes out of the head, it has entrained therein, paint which is contained or stored within the cup 14. The paint is aspirated by suitable means associated with the gun. For example, an aspirator tube communicates between the gun and the cup to create a pressure differential between the surface of the paint and the gun. In this manner, the aspirator tube, in essence, functions to siphon paint from the cup and into the container. Again, this function is well known to the skilled artisan. See, inter alia, U.S. Pat. No. 3,672,645. The aspirator tube can, conventionally, be disposed within a shroud 24. The gun, also, includes a cap 26 which is threadably connectable or otherwise removably secureable to the cup 14.

The cup 14 comprises any suitable container for the paint.

It is to be understood that the structure of the cup and the gun, per se, do not form part of the present invention. Rather, any conventional gun and cup assembly can be utilized in accordance herewith.

Referring, again, to the drawing, and as hereinbefore noted, the present invention contemplates an agitator 16 for maintaining the paint within the cup in a stirred or agitated state.

Figure 3:
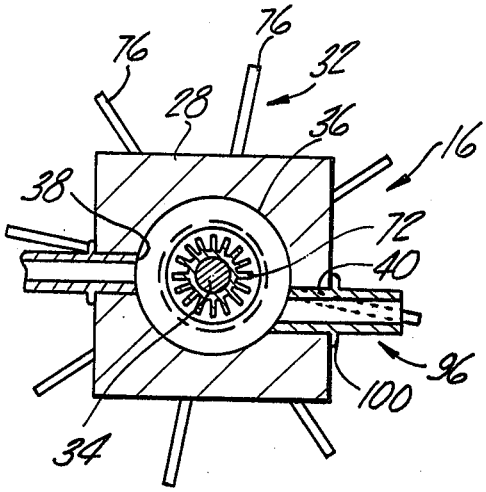
FIG. 3 is a cross-sectional view taken along the line 3—3 of FIG. 2.
Figure 4:
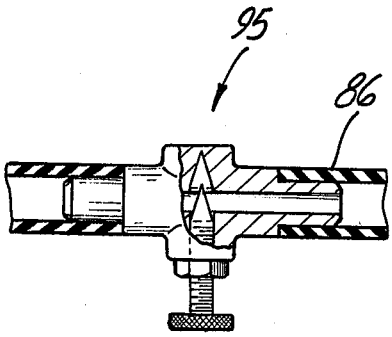
FIG. 4 is a sectional view of a speed regulating system utilized in the practice of the present invention.

The agitator 16 comprises a housing 28, means 30 for delivering pressurized fluid to the housing, a vaned paddle wheel 32 for stirring the paint and a shaft 34 which extends through the housing and which has the vaned paddle wheel journalled thereon. More specifically, the housing 28 comprises a unitary member having an internal cavity or chamber 36 formed therewithin. A lateral inlet 38 and an opposed outlet 40 are provided for the cavity. Preferably, the inlet and outlet are horizontally offset, as shown in FIG. 3. The offset relationship permits rotation of the shaft 34 in a manner to be described subsequently.

The inlet 38 is in registry with a lateral bore 42 formed in the housing and the cavity outlet 40 is in registry with a second lateral bore 44, likewise, formed in the housing.

Figure 2:
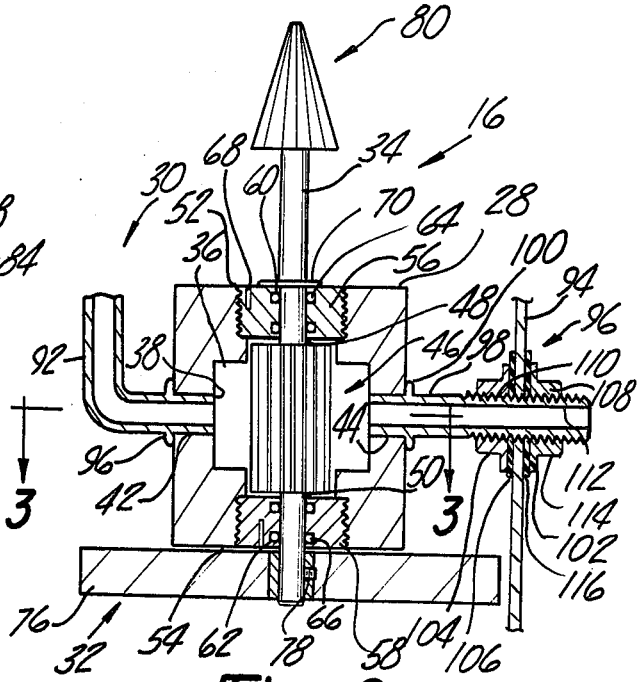
FIG. 2 is a cross-sectional view of the agitator of the present invention.

As clearly shown in FIGS. 2 and 3, the rotatable shaft 34 extends longitudinally through the housing 28 such that a portion thereof, generally, denoted at 46, is disposed within the cavity. Because of the nature of the spray paint assemblies it is incubent that the shaft be sealed to prevent paint from entering the housing. Thus, the present invention provides means for sealing the portions of the shaft near the periphery of the housing.

Each longitudinal or radial end of the cavity 36 is provided with an opening 48, 50 respectively. The openings 48, 50 open into communication with internally threaded seats 52, 54 respectively. Disposed within each set 52, 54 is a lock bolt or nut 56, 58 respectively. The lock bolts are externally threaded to be threadable inserted into their associated seats, such as with a spanner wrench or the like. Each bolt has a central bore provided therethrough. The shaft 34, as shown extends through the bores of the lock bolts 56 and 58.

In order to seal the shaft, each bolt is provided with at least one internal groove 60, 62 formed about their respective bores. Disposed in each groove is an O-ring seal 64, 66 which seals the shaft 34.

Alternatively, the grooves and O-ring seals can be formed and provided on the shaft 34.

A set screw 68 or the like can be used to lock the bolts in position.

As clearly shown in FIG. 2 fixedly mounted the shaft is a bearing plate or gasket 70. The plate 70 provides a cover over the seats 52 and functions as a stop for the shaft. The plate, when disposed in position, abuts against the housing 28.

As noted, the shaft includes a portion 46 which is disposed in the cavity 36. The shaft portion 46 has a plurality of radial splines or fins 72 extending outwardly therefrom. The fins extend substantially the length of the cavity. The fins 72 entrap pressurized fluid entering the cavity, and the forces exerted on the fins cause rotation of the shaft, proper. The splines or fins, are, preferably, integrally formed with the shaft. The splined portion of the shaft, as will be subsequently be explained has a diameter less than that of cavity openings 48 and 50 to facilitate cleaning of the housing and disassembling of the agitator unit. Because the inlet 38 is offset with respect to the outlet 40, i.e. non-axially aligned, a static condition is not created within the cavity. Alternatively, the inlet and outlet can be axially aligned by imparting an arc (not shown) to the fins 72.

Mounted on one end of the shaft 34 exteriorly of the housing 28 is the paddle wheel 32. The paddle wheel 32 comprises a central collar 74 which mounts about the shaft and a plurality of vanes 76. The vanes are integrally formed with and extend radially outwardly from the collar. The paddle wheel is fixed to the shaft via a set screw 78. It is to be, thusly, appreciated that as the shaft rotates, in response to the impingement of the pressurized fluid upon the fins, the paddle wheel concommitantly rotates. Because the agitator hereof is disposed within the paint, the rotation of the paddle wheel agitates the paint to keep the pigments suspended within the paint liquid vehicle.

Although not critical to the practice of the present invention, it is possible in accordance herewith to provide a second paddle wheel 80. The paddle wheel 80 is journalled on the end of the shaft opposite to the end where the paddle wheel 32 is mounted. The paddle wheel 80 is fixed to the shaft in the same manner heretofore described. It should be noted with respect hereto, that, although, the paddle wheel 80 is depicted as having a frusto-conical configuration with radiating fins 82, any other desired configuration can be utilized.

It should, also, be noted with respect hereto, that the paddle wheel 32 or wheels 32 and 80 are fixed on the shaft a sufficient distance to permit access to the entire exterior of the housing to permit the cleaning thereof. This is especially important when changing the color of the paint within the cup.

It should further be noted that the shaft and paddle wheel assembly is easily disconnected from the housing. The paddle wheel can be removed from the shaft by loosening the set screw 78. Thereafter, the lock bolts can be threadably removed from their associated seats. Because the splined portion of the shaft has a smaller diameter than that of the cavity openings and the seat, the shaft can be withdrawn from the housing.

Referring again to the drawing, and as hereinbefore noted, the present invention, also, includes means 30 for delivering pressurized fluid to the cavity 36 of housing 28 for rotating the shaft. The means 30 comprises a T-connection 84 interposed in conduit 18. Extending from the T-connection 84 is a conduit 86 which diverts a portion of the pressurized fluid. The other end of the conduit 84 is fitted with a threaded connector 88. The threaded connector 88 is threadably connected to an opposed threaded shank 90. The shank 90 defines a first end for a conduit 92. The conduit 92 extends through the sidewall 94 of the cup 14 through an aperture provided therein. A seal (not shown) is provided around the aperture to prevent the leakage of fluid therepast. The other end of the conduit 92 is disposed in the lateral bore 42 of the housing 28. The conduit is shrink fitted in the bore to provide a fluid tight seal. Also, a flange or shoulder 96 is integrally formed with the conduit, as a result of the shrink fitting, and abuts the sidewall of the housing around the bore 42.

In order to regulate the volume of pressurized fluid entering the cavity 36 and, thus, the speed of rotation of the shaft 34, speed regulating means, such as a check valve or needle valve asembly, or a conventional stop cock assembly 95 can be incorporated either into the conduit 86 or the threaded connector and shank assembly 88, 90. Such speed regulating means are well known, see, inter alia, U.S. Pat. No. 3,672,645.

In order to exhaust pressurized fluid from the cavity means, generally, indicated at 96, is, also, included. The means 96 comprises a conduit 98. The conduit 98 has first end thereof shrink fitted in the bore 44 and is in registry with the outlet 40. A flange or shoulder 100 integrally formed with the conduit 100 sealingly abuts the side wall of the housing, as shown. The conduit extends laterally outwardly away from the housing and extends through an aperture 102 provided in the sidewall 94 of the cup 14. The outer extent of the conduit is threaded, as shown at 110. In order to seal the aperture 102, a nut 104 is threadably mounted on the conduit. Interposed between the interior of the sidewall 94 and the nut 104 is a washer or similar seal 106. A lock nut 108 is threadably connected to the conduit exteriorly of the aperture 102. The lock nut 108 is threadably mounted on the conduit by internal threads 112. The nut, also, has a head 114 to facilitate the rotation thereof. Interposed between the nut and the sidewall is a washer 116 which exteriorly seals the aperture 102. Other modes can, of course, be utilized to sealingly extend the conduit 98 through the sidewall 94 to vent the pressurized fluid to the atmosphere.

It is to be appreciated that the entire agitator assembly can be easily removed from the cup by disconnecting the connections of the conduits. Thus, the agitator can be installed in any cup. Furthermore, and as hereinbefore noted, the shaft is removable from the housing to facilitate the cleaning thereof.

In manufacturing the present agitator any suitable materials can be utilized. Preferably, the entire agitator is formed from a plastic which is inert to the organic solvents used in the paint, such as bakelite, polycarbonate and the like.

Having, thus, described the invention, what is claimed is:

1. An agitator for a paint spray assembly, comprising:
(a) a housing adapted to be disposed within a cup, the housing having an internal cavity,
(b) a shaft removably mounted to the housing and extending through the housing, the shaft having an enlarged splined section disposed within the cavity,
(c) a vaned paddle wheel mounted on the shaft exteriorly of the housing,
(d) a first lateral bore formed in the housing and extending radially outwardly from the cavity and defining means for delivering pressurized fluid to the cavity to rotate the shaft by the impingement of fluid on the spline, and
(e) a second lateral bore formed in the housing and extending laterally outwardly from the cavity, the bore being axially offset from the first bore, the second bore defining means for exhausting the fluid from the cavity.

2. The agitator of claim 1, which further comprises:
means for regulating the speed of rotation of the shaft.

3. The agitator of claim 1, which further comprises:
(a) a pair of threaded opposed seats formed in the housing and in registry with the cavity,
(b) a pair of lock bolts, one for each of the seats, each bolt being threadably disposed in the seats,
(c) each bolt having a central throughbore, the throughbores being in registry,
(d) sealing means disposed in each bolt about the throughbores thereof, and wherein the shaft extends through the throughbores and is sealed by the sealing means.

4. The agitator of claim 1 which further comprises:
a second paddle wheel, the second paddle wheel being mounted on the shaft exteriorly of the housing and on the end of the shaft opposite to that where the first shaft is mounted.

5. The agitator of claim 1 wherein;
the means for delivering pressurized fluid further comprises:
a conduit, the conduit having one end thereof fitted within the first lateral bore and communicating with the cavity, the other end of the conduit being connected to a source of pressurized fluid.

6. A paint spray assembly, comprising, in combination;
(a) a paint spray gun,
(b) a cup for storing paint therewithin, the cup being in fluid communication with the gun, and
(c) an agitator disposed in the cup, the agitator comprising the agitator of claim 1.

7. The assembly of claim 6 which further comprises:
means for regulating the speed of rotation of the shaft, the regulating means being associated with the means for delivering the pressurized fluid.

* * * * *